US005122195A

United States Patent [19]

Hoffman

[11] Patent Number: 5,122,195

[45] Date of Patent: Jun. 16, 1992

[54] METHOD OF REMOVING FOREIGN MATERIAL FROM BRUSH BRISTLES

[76] Inventor: Donna Hoffman, 121 Duane St., Battle Creek, Mich. 49017

[21] Appl. No.: 545,899

[22] Filed: Jun. 29, 1990

[51] Int. Cl.[5] ..... B08B 7/00; B08B 7/02; A46B 3/06; A46B 17/06

[52] U.S. Cl. ..... 134/38; 134/42; 15/38; 15/142; 15/223

[58] Field of Search ..... 15/38, 142, 223; 134/42, 38

[56] References Cited

U.S. PATENT DOCUMENTS

| | | | |
|---|---|---|---|
| 2,827,647 | 3/1958 | Speer | 15/142 |
| 3,837,988 | 9/1974 | Hennen et al. | 156/72 |
| 4,827,554 | 5/1989 | Cain | 15/142 |
| 4,829,622 | 5/1989 | O'Sullivan | 15/223 |

*Primary Examiner*—Theodore Morris
*Assistant Examiner*—Zeinab El-Arini
*Attorney, Agent, or Firm*—Flynn, Thiel, Boutell & Tanis

[57] ABSTRACT

A method for removing paint or other foreign matter from the bristles of a brush involves the use of an open web of interengaged, continuous, crinkled, coarse filaments of a resilient thermoplastic polymeric material which are removably welded together at points of mutual contact. The bristles of the brush may be wetted and rubbed against the open web while in a prone position in order to remove the foreign matter therefrom. In instances where heavy build-up is present on the brush bristles, the brush bristles are rubbed against the open web while in a supine position so that the filaments of the web may reach along the entire surface of the bristles. This cleaning method enables the continuous reuse of the paintbrush without any deterioration of the brush bristles from the cleaning operation.

14 Claims, 1 Drawing Sheet

METHOD OF REMOVING FOREIGN MATERIAL FROM BRUSH BRISTLES

BACKGROUND OF THE INVENTION

This invention relates to a method of removing foreign matter from the bristles of a brush. More particularly, the invention relates to a method of removing foreign matter from the bristles of a brush by rubbing the brush bristles against an open web of interengaged, continuous, crinkled, coarse filaments of a resilient thermoplastic polymeric material which are removably welded together at points of mutual contact.

At the present time, there is no effective way of removing paint or build-up from the bristles of a paintbrush without attendant damage to the paintbrush itself. A typical method for cleaning a paintbrush used in the painting of wooden, cloth and ceramic articles comprises the placing of the paintbrush in a prone position and the rubbing of the brush bristles in a circular motion in the palm of the hand of the person attempting to clean the brush. This method is highly ineffective in that it drives the paint to the center of the brush at the base of the brush bristles where the paint dries and hinders the movement of the brush bristles.

Another method of removing paint or foreign matter from paintbrush bristles comprises the soaking of the dirty bristles in a solvent in order to remove the foreign matter therefrom. However, during this soaking, the solvent is soaked up into the ferrule of the brush and subsequently dissolves the glue binding the base of the bristles and eventually results in the bristles separating from the paintbrush.

A commercially available device for removing foreign matter from the bristles of a paintbrush comprises a tray having a plurality of resilient knobs contained therein. A solvent is placed in the tray and the brush bristles are rubbed against the knobs in an attempt to remove the foreign matter therefrom. However, this device is not satisfactory as the rubbing of the paintbrush bristles against the knobs forces the paint up into the center of the brush and the solvent is forced up into the brush ferrule where it dissolves the glue binding the base of the brush bristles.

Therefore, there is a need for a method for removing paint or foreign material from the bristles of a paintbrush which effectively removes the foreign matter from the brush bristles and yet does not drive the paint into the center of the brush bristles and a cleaning solvent into the paintbrush ferrule.

Accordingly, it is an object of the present invention to provide an inexpensive method for removing paint or foreign material from the bristles of a paintbrush which does not drive the paint or foreign material into the center of the paintbrush bristles.

It is a further object of the present invention to provide an inexpensive method of removing paint and foreign matter from the bristles of a paintbrush which does not drive a solvent into the ferrule of a paintbrush.

It is a still further object of the present invention to provide a method for removing paint and foreign matter from the bristles of a paintbrush which allows the paintbrush to be cleaned repeatedly without any attendant deterioration to the paintbrush.

SUMMARY OF THE INVENTION

These and other objects of the present invention are accomplished by providing a method for removing foreign matter from the bristles of a brush comprising the step of rubbing the brush bristles against an open web of interengaged, continuous, crinkled, coarse filaments of a resilient thermoplastic polymeric material which are removably welded together at points of mutual contact.

In one embodiment of the present invention, when the build-up on the brush bristles is not very heavy or the brush is being cleaned immediately after use, the paintbrush is placed in a prone position, the brush bristles and the filaments of the web are wetted and the paintbrush bristles are brought into contact with the web and rubbed lightly against the web filaments in order to remove the foreign matter from the brush bristles.

In another embodiment of the present invention, where the paint or foreign matter has dried on the brush bristles or an especially difficult to remove build-up is present on the brush bristles, the paint brush is placed in a supine position and the index finger of the hand holding the brush is placed on top of the brush bristles in order to force the entire length of the brush bristles into contact with the filaments of the web and the bristles forcibly rubbed thereagainst.

The term "removably welded", used to describe the nature of the bond between the filaments, denotes that while the bonds between the filaments are sufficient to permit handling of the web as an integral unit, the welds are sufficiently weak to permit removal of a single filament without gross damage thereto.

DETAILED DESCRIPTION OF THE INVENTION

Figure 1:
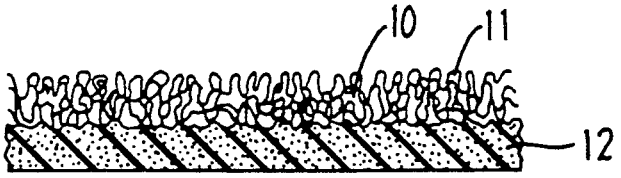
FIG. 1 is an end view of a mat comprising the open web of interengaged, continuous, crinkled, coarse filaments of a resilient thermoplastic polymeric material laminated onto a substrate.

As shown in FIG. 1, the web 10 of the present invention comprises a plurality of interengaged, continuous, coiled filaments 11 of a thermoplastic material which are removably welded together at points of mutual contact. The web can be prepared as disclosed in U.S. Pat. No. 3,837,988, the disclosure of which is incorporated herein by reference thereto. The web 10 is preferably laminated to a sheet-like substrate 12 to form a laminated mat structure.

Suitable polymeric materials for the web include polycarbonate, polyalkylene, polyester, polyvinyl, polyamide, ionomer and resins which are extrudable at elevated temperatures in the form of soft, flexible continuous filaments in which at lower temperatures have the required stiffness and toughness to make them suitable for use in the present invention, and other required physical and chemical characteristics to permit cohesion of the filaments. Particular polymers may contain plasticizers or softeners that may be otherwise modified by the addition of coloring agents, fibers or nonfibers reinforcing agents, stabilizers, fillers and other additives. The substrate 12 is preferably an open-celled or close-celled foam or sponge layer.

Figure 2:
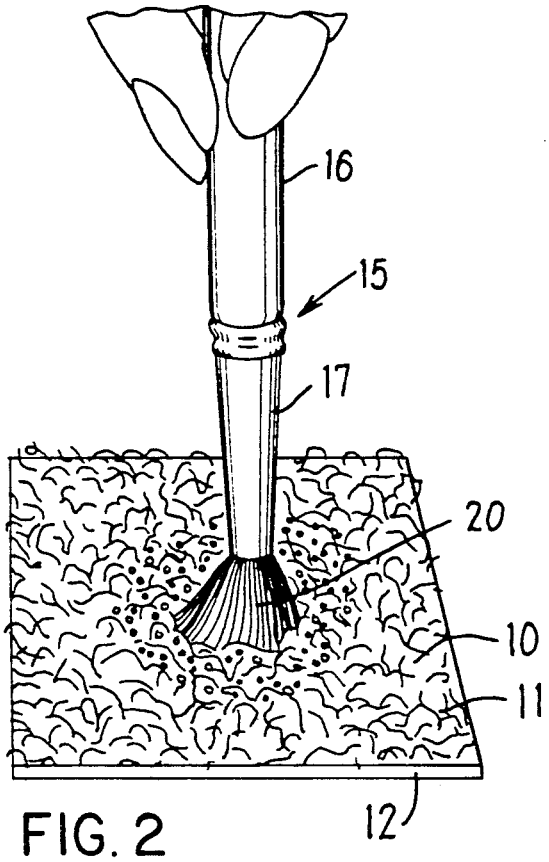
FIG. 2 is an illustration of the brush position used when removing light build-up from the bristles of the brush in the method of the present invention.

FIG. 2 illustrates a method of cleaning a paintbrush 15 according to the method of the present invention when the paintbrush bristles 20 contain a light build-up or when the paintbrush 15 has recently been used. The illustrated paintbrush 15 comprises a handle 16, bristles 20 and a ferrule 17 joining the handle 16 and the bristles 20. Although a specific type of paintbrush 15 is illustrated, the present invention can be used to remove foreign material from the bristles of all types of brushes. Consequently, all types of bristles, such as saddle bristles, sable bristles, camel hair bristles, ox hair bristles, TEFLON® bristles and nylon bristles, etc. can be cleaned according to the method of the present invention.

In cleaning a paintbrush 15 having a light build-up on the bristles 20, the tip of the bristles are first dipped in a solvent such as water to wet them. The bristles 20 are then dipped in an aqueous cleaning composition. The cleaning composition may contain any type of cleaner such as a shampoo, soap or scouring powder. The web 10 is then wetted with a solvent such as water. The tips of the bristles 20 are then rubbed gently against the filaments 11 of the web in order to remove the paint or build-up therefrom.

Because of the structure of the web 10, the filaments 11 are able to evenly separate and penetrate the interior of the brush bristles 20 and effectively remove foreign material therefrom without forcing the foreign material into the base of the bristles 20 and the solvent into the paintbrush ferrule 17. After the foreign matter has satisfactorily been removed from the brush bristles 20, the bristles are dried against a soft cloth and then the paintbrush 15 is ready for reuse.

Figure 3:
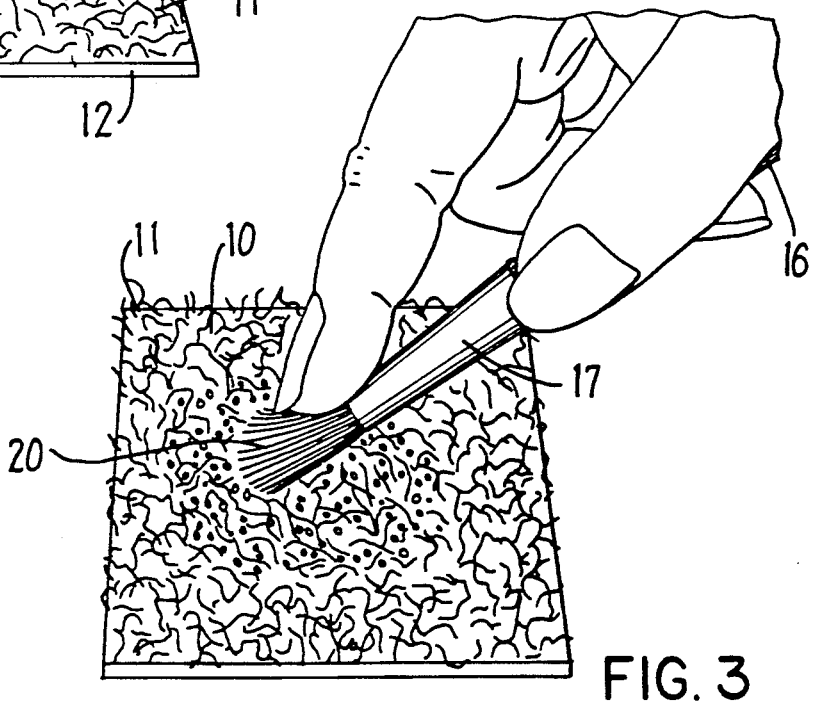
FIG. 3 is an illustration of the brush position used in removing heavy build-up or a difficult to remove material from the bristles of the brush in the method of the present invention.

FIG. 3 illustrates another embodiment of the present invention wherein heavy build-up or a difficult to remove material is cleaned from the brush bristles 20. As in the above discussion, the brush bristles 20 are first wetted in a solvent such as water and then dipped in a cleaning solution. The web 10 is then wetted with a solvent such as water and the bristles 20 of the brush 16 brought into contact with the filaments 11 of the web 10. However, in this particular embodiment, the paintbrush 15 is placed in a supine position so that the entire length of the bristles 20 is brought in contact with the web 10. The index finger of the hand holding the brush 15 is brought to bear on the upper surface of the brush bristles 20 so as to force the bristles 20 to evenly spread out over the upper portion of the web 10. The bristles 20 are then forcibly rubbed back and forth against the filaments 11 of the web 10 in order to enable the web filaments 11 to engage with and remove the heavy build-up or difficult to remove foreign material from the bristles 20. By evenly spreading the bristles 20 over the upper surface of the web 10, the filaments 11 are brought in contact with the entire exterior surface of the brush bristles 20 and able to remove the foreign material therefrom along the entire length and width of the bristles 20.

Other modifications of the invention are possible without departing from the scope of the claims. For example, it is not necessary to wet either the brush bristles 20 or the web 10 before using the claimed method to remove the foreign matter from the brush bristles. Additionally, any type of solvent is suitable for use in the present invention as long as it is not destructive to the brush bristles 20 or the web 10.

The embodiments of the invention in which an exclusive property or privilege is claimed are defined as follows:

1. In a method of removing foreign matter from bristles of a brush, the improvement comprising the step of rubbing said brush bristles in a manner that does not drive the foreign material into the center of the brush bristles against an open web of interengaged, continuous, crinkled, coarse filaments of resilient thermoplastic polymeric material removably welded together at points of mutual contact in order to remove said foreign matter therefrom wherein at least one major surface of said web is flattened and the portion of said web adjacent said flattened major surface has a higher density of filaments than elsewhere in said web.

2. The method of claim 1, wherein said brush bristles are wetted by a solvent prior to said step of rubbing said bristles against said open web.

3. The method of claim 1, wherein said brush bristles are wetted by an aqueous cleaning solution prior to said step of rubbing said bristles against said open web.

4. The method of claim 1, wherein said open web is wetted by a solvent prior to said step of rubbing said bristles against said open web.

5. The method of claim 2, wherein said solvent is water.

6. The method of claim 4, wherein said solvent is water.

7. The method of claim 1, wherein said brush bristles are in a prone position during the rubbing of said brush bristles against said open web.

8. The method of claim 1, wherein said brush bristles are in a supine position during the rubbing of said brush bristles against said open web.

9. The method of claim 1, wherein said filaments have a diameter of between about 5 and about 125 mils.

10. The method of claim 1, wherein said flattened surface of said web is laminated to a substrate.

11. In a method of removing foreign matter from bristles of a brush, said bristles being selected from the group consisting of saddle bristles, sable bristles, camel hair bristles, ox hair bristles, polytetrafluoroethylene bristles and nylon bristles, the improvement comprising the step of rubbing said brush bristles in a manner that does not drive the foreign material into the center of the brush bristles against an open web of interengaged, continuous, crinkles coarse filaments of resilient thermoplastic polymeric material removably welded together at points of mutual contact in order to remove said foreign matter therefrom, said open web being disposed in a supine position wherein at least one major surface of said web is flattened and the portion of said web adjacent said flattened major surface has a higher density of filaments than elsewhere in said web.

12. The method of claim 11, wherein said brush bristles are in a prone position during the rubbing of said brush bristles against said open web.

13. The method of claim 11, wherein said brush bristles are in a supine position during the rubbing of said brush bristles against said open web.

14. The method of claim 11, wherein said filaments have a diameter of between 5 and 125 mils.

* * * * *

UNITED STATES PATENT AND TRADEMARK OFFICE

CERTIFICATE OF CORRECTION

PATENT NO. : 5 122 195

DATED : June 16, 1992

INVENTOR(S) : Donna HOFFMAN

It is certified that error appears in the above-identified patent and that said Letters Patent is hereby corrected as shown below:

Column 4, line 50; change "crinkles" to ---crinkled---.

Signed and Sealed this

Fifth Day of October, 1993

Bruce Lehman

*Attest:*

BRUCE LEHMAN

*Attesting Officer*

*Commissioner of Patents and Trademarks*